United States Patent [19]

Stedman

[11] 4,054,185

[45] Oct. 18, 1977

[54] MAST CONTROL MECHANISM

[75] Inventor: Robert N. Stedman, Chillicothe, Ill.

[73] Assignee: Caterpillar Tractor Co., Peoria, Ill.

[21] Appl. No.: 705,847

[22] Filed: July 16, 1976

[51] Int. Cl.[2] ..... B66F 9/20

[52] U.S. Cl. ..... 187/9 E; 214/DIG. 10

[58] Field of Search ..... 187/1 R, 9 R, 9 E, 18, 187/95, 17; 214/670, 671, 672, 673, 674, 660, DIG. 10; 254/10 R, 10 B, 10 C, 122

[56] References Cited

U.S. PATENT DOCUMENTS

| | | | |
|---|---|---|---|
| 2,877,868 | 3/1959 | Gunning et al. | 187/9 E |

FOREIGN PATENT DOCUMENTS

| | | | |
|---|---|---|---|
| 99,672 | 11/1964 | Denmark | 214/672 |
| 1,203,701 | 1/1960 | France | 214/671 |
| 1,256,406 | 2/1961 | France | 187/9 R |
| 837,344 | 6/1960 | United Kingdom | 214/671 |

*Primary Examiner*—Evon C. Blunk

*Assistant Examiner*—James L. Rowland

*Attorney, Agent, or Firm*—John W. Grant

[57] ABSTRACT

An upwardly extending mast is disposed adjacent the forward end of a vehicle main frame of a lift truck. A mounting plate device extends upwardly from the forward end of the main frame with the forward ends of a first pair of longitudinally extending vertically spaced parallel arms pivotally connected thereto. A second pair of longitudinally extending vertically spaced parallel arms have their rearward ends individually pivotally connected to the rearward ends of the first pair of arms and their forward ends pivotally connected to the mast. A vertical link has its opposite ends pivotally connected to the rearward ends of at least one pair of the arms while a motor device is provided to raise the mast relative to the main frame. A control linkage device is pivotally anchored to the main frame and pivotally connected to one arm of the first pair of arms and to the mast so that the control linkage device causes the mast to move in a substantially straight path as it is raised.

7 Claims, 4 Drawing Figures

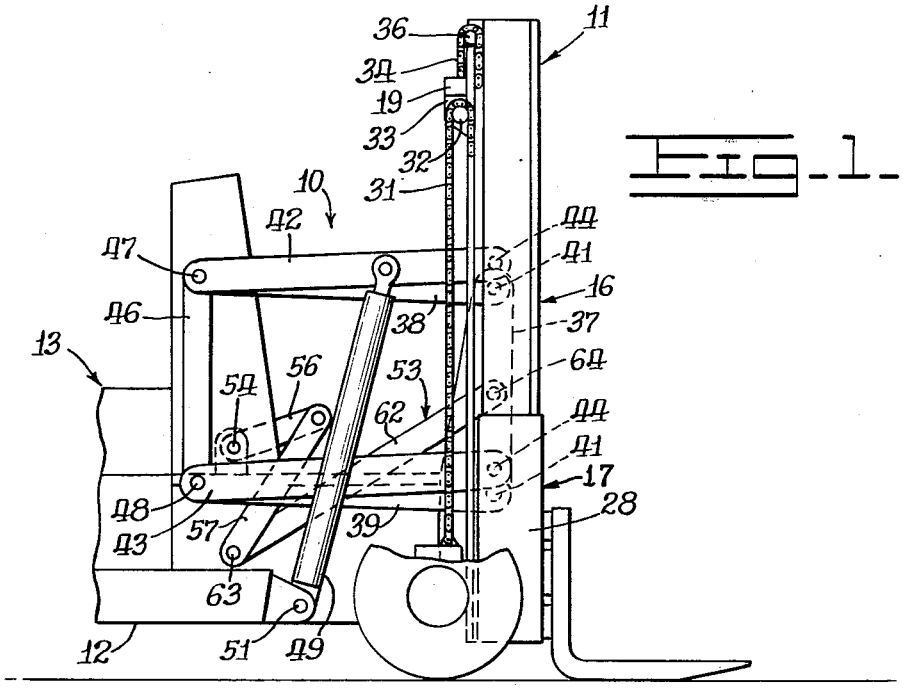
Fig. 1
Fig. 4
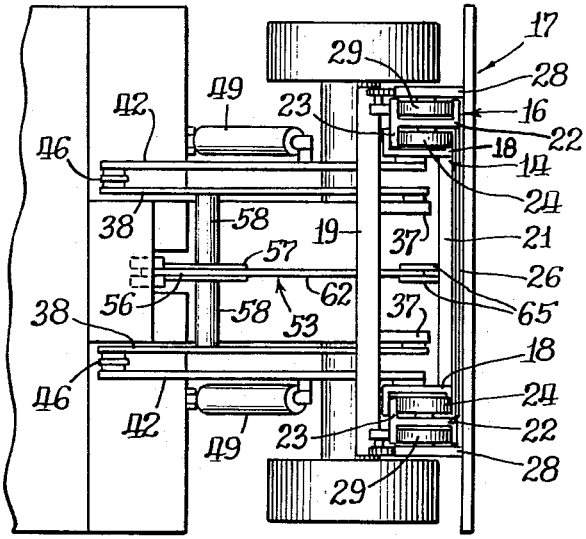

MAST CONTROL MECHANISM

BACKGROUND OF THE INVENTION

This invention relates to a lift truck and more particularly to the mast control mechanism for mounting the mast to the lift truck.

Fork lift trucks are widely used in many industries for stacking operations wherein material is stacked in vertical tiers. To conserve floor space, the distance between the vertical tiers is minimal and the lift trucks are generally designed with a short wheel base for maneuverability in such cramped quarters. Thus, the load carrying capacity is governed partially by the distance that the forks extend ahead of the front wheels. For this reason, the placement of the forks and the mast relative to the front wheels throughout their working lift height is an important consideration in all lift truck designs.

OBJECTS OF THE INVENTION

Accordingly, an object of this invention is to provide an improved mast control mechanism which provides for the mounting of a mast in close proximity to the forward end of a lift truck.

Another object of this invention is to provide such an improved mast control mechanism which permits the overall height of the mast to be reduced without sacrifice to the maximum lift height capability.

Another object of this invention is to provide an improved mast control mechanism of the character described in which the forks are translated in a substantially straight path during raising and lowering thereof.

Other objects and advantages of the present invention will become more readily apparent upon reference to the accompanying drawings and following description.

BRIEF DESCRIPTION OF THE DRAWINGS

FIG. 1 is a side elevational view of a mast control mechanism embodying the principles of the present invention in association with a lift truck.

FIG. 4 is a top plan view of the mast control mechanism.

DESCRIPTION OF THE PREFERRED EMBODIMENT

Figure 2:
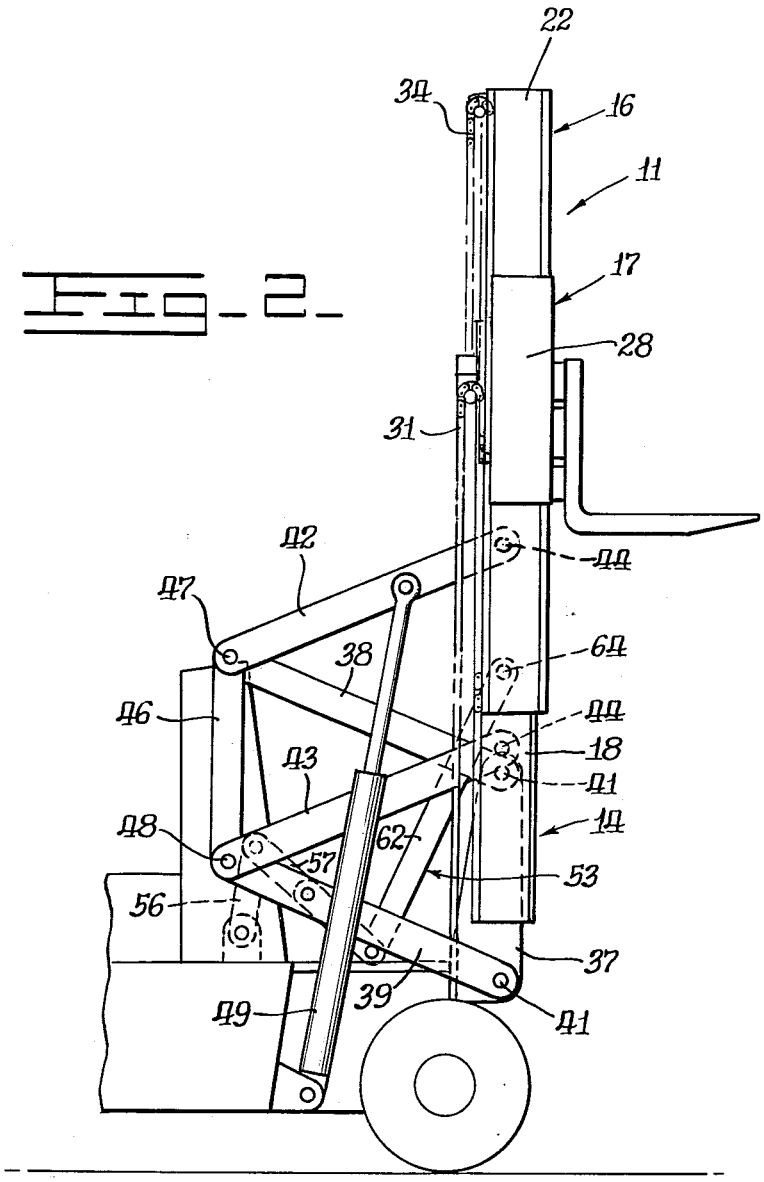
FIGS. 2 and 3 are side elevational views of the mast control mechanism of FIG. 1 with the forks elevated to intermediate and full lift positions respectively.

Referring now to the drawings, a mast control mechanism embodying the principles of the present invention is generally indicated by the reference numeral 10 for mounting a mast 11 to the forward end of a longitudinally extending main frame 12 of a lift truck partially shown at 13. The mast includes an upwardly extending inner upright 14, an upwardly extending outer upright 16 mounted to the inner upright for telescopic movement therebetween, and a fork carriage 17 mounted to the outer upright for generally vertical movement relative thereto. The inner upright includes a pair of laterally spaced parallel channel members 18 which, as more clearly shown in FIG. 4, open outwardly away from each other and are rigidly interconnected by a tie bar 19 fixedly secured to the rearward edges thereof at their upper ends and a plate 21 fixedly secured between the channel members at their forward edges intermediate their ends.

The outer upright 16 has a pair of laterally spaced parallel channel members 22 individually disposed on the outboard side of the inner channel members 18 and open outwardly away from each other. Each channel member has a J-shaped cross section with an inwardly extending flange 23 protruding into the respective inner channel member. A plurality of rollers, two of which are shown at 24 are rotatably mounted to the inner and outer channel members in the usual manner to provide for the telescopic movement between the inner and outer uprights. The outer channel members are interconnected at their forward edges by a plurality of cross plates, one of which is shown at 26, with the plates vertically spaced along the length of the outer channel members.

The fork carriage 17 includes a pair of vertically extending side plates 28 individually disposed on the outboard side of the outer channel members 22. A plurality of rollers, two of which are shown at 29, are rotatably mounted to the vertical plates and are rollably arranged within the respective outer channel members.

Figure 3:
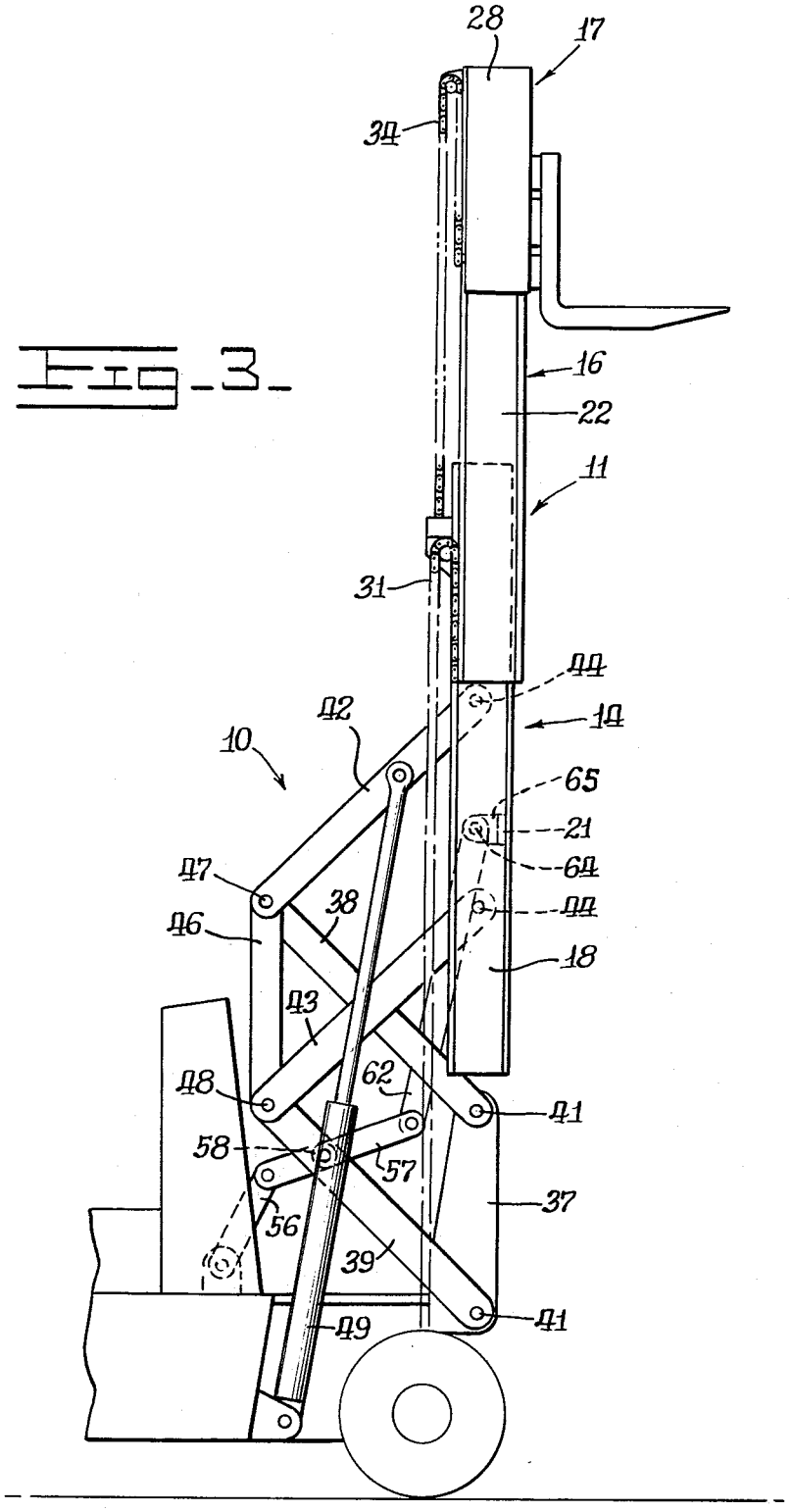

A first pair of elongated flexible chains 31 are individually looped over a pair of chain rollers, one shown at 32 in FIGS. 1-3, each of which is rotatably mounted to a supporting block 33 rigidly secured to the rearward edge of the inner channel member 18. One end of each chain is anchored to the main frame while the other end thereof is attached to the lower portion of the respective outer channel member 22. A second pair of flexible chains 34 are similarly individually looped over a pair of chain rollers, one shown at 36 in FIGS. 1–3, each chain roller being rotatably mounted to the upper rearward edge of the outer channel members 22. One end of each chain 34 is anchored to the tie bar 19 while the other end thereof is attached to a respective side plate 28 of the fork carriage 17.

A pair of laterally spaced mounting plates 37 are rigidly secured to the forward end of the main frame 13 and extend upwardly therefrom partially between the inner channel members 18 of the inner upright 14. Each pair of two pair of longitudinal extending arms include upper and lower vertically spaced parallel arms 38 and 39, respectively, having their forward ends pivotally connected to the outboard side of the respective mounting plate by a pair of vertically spaced pivot pins 41. Each pair of two other pair of longitudinally extending arms include upper and lower vertically spaced parallel arms 42 and 43, respectively, having their forward ends pivotally connected to the inboard side of the respective inner channel member by a pair of vertically spaced pivot pins 44. The rearward ends of the upper arms at one side of the lift truck are pivotally connected to each other and the upper end of a vertically extending link 46 by a pivot pin 47 while the rearward ends of the lower arms at the same side of the lift truck are connected to each other and the lower end of the link by a pivot pin 48. All of the arms have the same effective length which is the length between the pivot pins at the opposite ends of the arms. The above described arm arrangement forms two parallelograms at each side of the lift truck with one parallelogram including upper and lower arms 38 and 39, link 46 and the mounting plate while the other parallelogram includes upper and lower arms 42 and 43, respectively, link 46 and the portion of the inner channel members between pins 44. A pair of fluid actuated lift jacks 49 are pivotally anchored to the main frame at pivots 51 while their rod ends are pivotally connected to the upper arms 42 intermediate their ends.

A centrally disposed control linkage arrangement 53 is pivotally anchored to the main frame at a pivot 54 and is pivotally connected to the lower arms 39 and to the mast for causing the mast to move in a substantially straight vertical path upon actuation of the lift jack. More specifically, the control linkage arrangement includes a first link 56 having one end pivotally connected to the main frame at the pivot 54. A lever 57 is pivotally mounted between a pair of laterally extending axially aligned cross tubes 58 which have their outer ends fixedly secured to the inner sides of the lower arms 39. The opposite end of the lever is pivotally connected to one end of a second link 62 by a pivot pin 63. As more clearly shown in FIG. 3 and 4, the other end of the second link is pivotally connected by a pivot pin 64 to a pair of rearwardly extending lugs 65 secured to the rear plate 21 extending between the inner channel members 18.

OPERATION

While the operation of the present invention is believed clearly apparent from the foregoing description, further amplification will subsequently be made in the following brief summary of such operation. With the lift jacks 49 in their retracted position, the mast control machansim 10 is in the position shown in FIG. 1. Extending the hydraulic jacks pivots the upper and lower arms 42 and 43 about the pins 47 and 48 and causes the mast 11 to commence moving upwardly. By virtue of its pivotal connection to the inner upright 14, the outer end of the second link 62 also moves upwardly and causes the lever 57 to pivot about its pivotal connection to the lower arms 39. At the same time, the first link 56 acts as a fulcrum for the lever thereby causing the lower and upper arms 39 and 38, respectively, to pivot about the pivot pins 41. As sequentially shown by FIGS. 1, 2 and 3, the length of the first and second links, the lever, and their respective pivot points are chosen to cause the upper and lower arms 38 and 39 to pivot about their pivot pins 41 an amount equal to the pivotal movement of the upper and lower arms 42 and 43 about their pins 47 and 48. Thus, the tendency of the mast to move rearwardly due to the pivotal action of the upper and lower arms 42 and 43 about their pivot pins 47 and 48 is offset by the forward movement of the pins 47 and 48 due to the pivotal action of the upper and lower arms 38 and 39 about their pivots 41 such that the net results is that the mast moves in a substantially straight vertical path upon extension or retraction of the lift jacks 49.

The inner upright 14 is raised directly by extension of the lift jacks 49 by virtue of the connection between the inner channel members 18 and the upper and lower means 42 and 43. With the first flexible chains 31 being anchored to the main frame, the upward movement of the inner upright causes the first flexible chains simultaneously to pull the outer upright 16 upwardly relative to the inner upright a distance equal to the movement of the inner upright. Likewise, with the second flexible chains 34 being anchored to the inner upright, the upward movement of the outer upright causes the second flexible chain to pull the fork carriage upwardly relative to the outer upright a distance equal to the movement of the outer upright. Thus a triple mast effect is achieved with only a double mast section. Retracting the lift jacks from their extended condition reverses the above operation and the fork carriage, outer upright, and inner upright are returned to their lower position.

In view of the foregoing, it is readily apparent that the structure of the present invention provides an improved mast control mechanism which permits the mast to be mounted in close proximity to the forward end of the lift truck and controls the position of the mast relative to the lift truck throughout its full range of lifting heights. This is achieved by mounting the mast to the main frame through a double parallelogram linkage and controlling the movement of the parallelogram linkages so that the arcuate movement of one parallelogram linkage in one direction is offset by the arcuate movement of the other parallelogram linkage in the opposite direction. Furthermore, by providing a triple mast effect with a double mast arrangement, the overall height of the mast is reduced without sacrificing the maximum lift height capability.

While the invention has been described and shown with particular reference to the preferred embodiment, it will be apparent that variations might be possible that would fall within the scope of the present invention which is not intended to be limited except as defined in the following claims.

What is claimed is:

1. A mast control mechanism in combination with a lift truck of the type having a longitudinally extending main frame comprising:

a vertical mast disposed adjacent the forward end of the main frame;

mounting means extending upwardly from the forward end of the main frame;

means for pivotally connecting the mast to the mounting means for pivotally moving the mast between a lowered position and a raised position, said means including a first pair of longitudinally extending vertically spaced parallel arms having their forward ends pivotally connected to the mounting means, a second pair of longitudinally extending vertically spaced parallel arms having their rearward ends individually connected to the rearward ends of the first pair of arms and their forward ends pivotally connected to the mast, and a vertically extending link having its opposite ends pivotally connected to the rearward ends of at least one arm of each pair of the arms;

means for moving the mast between the lowered and raised positions; and control linkage means pivotally anchored to the main frame and pivotally connected to one arm of the first pair of arms and to the mast so that the control linkage means causes the mast to move in a substantially straight vertical path as it is raised.

2. The mast control mechanism of claim 1 wherein the control linkage means includes first and second links pivotally connected to the main frame and mast respectively, and a lever having its opposite ends individually pivotally connected to the respective ends of the first and second links and an intermediate portion thereof pivotally connected to the lower arm of the first pair of arms.

3. The mast control mechanism of claim 2 wherein all of the arms have the same effective length.

4. The mast control mechanism of claim 3 wherein the mast includes an upwardly extending upright and a load lifting device operatively associated with the upright for upward movement relative thereto, and means for raising the load lifting device relative to the upright automatically simultaneously upon raising the mast.

5. The mast control mechanism of claim 4 wherein said means for raising the load lifting device includes a roller rotatably attached to the upper end of the upright and an elongated flexible member looped over the roller and having one of its ends anchored to the frame and its other end attached to the load lifting device.

6. The mast control mechanism of claim 5 wherein the load lifting device includes another upright operatively associated with said upright for guided vertical movement relative thereto and a fork carriage operatively associated with the other upright for guided vertical movement relative thereto, said other end of said flexible member being attached to the other upright.

7. The mast control mechanism of claim 6 including another roller rotatably attached to the upper end of the other upright, and another elongated flexible member looped over the other roller and having one of its ends anchored to theupright and its other end attached to the fork carriage.

* * * * *